United States Patent [19]

Shimada et al.

[11] 4,323,737

[45] Apr. 6, 1982

[54] DRIVER UNIT FOR PLANAR DIAPHRAGM TYPE LOUDSPEAKER

[75] Inventors: Kunihiko Shimada; Yukio Tsuchiya, both of Tokorozawa, Japan

[73] Assignee: Pioneer Electronic Corporation, Tokyo, Japan

[21] Appl. No.: 164,398

[22] Filed: Jun. 30, 1980

[30] Foreign Application Priority Data

Jun. 30, 1979 [JP] Japan ..... 54-90266
Jun. 30, 1979 [JP] Japan ..... 54-90272

[51] Int. Cl.[3] ..... H04R 9/02; H04R 9/04; H04R 9/06

[52] U.S. Cl. ..... 179/115.5 R; 179/115.5 VC

[58] Field of Search ..... 179/115.5 R, 115.5 VC, 179/117, 119 R, 120, 181 R, 181 F; 181/157, 163, 164, 165, 167–174

[56] References Cited

U.S. PATENT DOCUMENTS

| | | | |
|---|---|---|---|
| 3,268,672 | 8/1966 | Roesel, Jr. et al. | 179/115.5 R |
| 3,464,514 | 9/1969 | Mochida et al. | 179/115.5 ES |
| 3,603,427 | 9/1971 | Sotome | 181/167 |
| 3,979,566 | 9/1976 | Willy | 179/115.5 VC |
| 4,013,846 | 3/1977 | Krawczail et al. | 179/181 F |

FOREIGN PATENT DOCUMENTS

| | | | |
|---|---|---|---|
| 732959 | 2/1943 | Fed. Rep. of Germany | 179/115.5 R |
| 1332315 | 6/1963 | France | 179/115.5 R |
| 398488 | 9/1933 | United Kingdom | 179/115.5 VC |
| 2023375 | 12/1979 | United Kingdom | 179/115.5 R |

*Primary Examiner*—George G. Stellar
*Attorney, Agent, or Firm*—Sughrue, Mion, Zinn, Macpeak & Seas

[57] ABSTRACT

A driver unit for a square planar diaphragm type loudspeaker system in which a voice coil bobbin attached to the square planar diaphragm is supported by a corrugated damper the other end of which is attached to a heat conducting support whereby heat generated within the voice coil of the speaker can be readily dissipated. A square magnetic circuit is provided including a plurality of straight magnetic circuit sections positioned along corresponding sides of the square planar diaphragms. Each of these straight magnetic circuit sections includes a pair of parallel plate members along inner walls of which opposite plurality magnets are disposed and with a yoke connecting the opposite ends of the plate members. The voice coil which is attached to the voice coil bobbin is disposed in the air gap between oppositely disposed magnets. The damper support is mounted on the outer plate member with a flange portion extending over the upper edge of the outer plate member and having an upper flange portion to the upper surface of which the damper is attached. The damper is formed of a corrugated section of treated cloth which has no elasticity in its longitudinal direction but which is free to move in a direction perpendicular to the plane of the diaphragm.

4 Claims, 4 Drawing Figures

DRIVER UNIT FOR PLANAR DIAPHRAGM TYPE LOUDSPEAKER

BACKGROUND OF THE INVENTION

The present invention relates to planar diaphragm type loudspeaker systems. More particularly, the invention relates to a driver unit for use in a planar diaphragm type loudspeaker system.

It is known that a planar diaphragm has acoustic pressure characteristics relatively flat over a wide frequency range without shifting of the acoustic image thus providing high fidelity sound reproduction. A variety of such type loudspeaker systems have been proposed. In conventional planar diaphragm type loudspeaker systems, loudspeaker units adapted to reproduce bass, mid and treble-ranges have been independently and separately mounted on a baffle board of the loudspeaker system. The planar diaphragms, although they were square in shape, were driven by circular driver units. This arrangement is, however, disadvantageous in that it is difficult for the circular driver unit to make the whole square planar diaphragm reciprocate uniformly. Furthermore, a voice coil for use in a planar diaphragm type loudspeaker unit is generally positioned in the vicinity of the planar diaphragm and air is sealed around the voice coil by the planar diaphragm and a magnetic circuit. Therefore, heat generated by the voice coil is cut off from escape resulting in a deterioration in the reproduction characteristics.

In such a multi-way planar diaphragm type loudspeaker system, in order to obtain improved acoustic pressure characteristics which are flat over a wide frequency range without shifting of the acoustic image, a coaxial multi-way planar diaphragm type loudspeaker system of simple construction has been proposed in co-pending U.S. Patent Application Ser. No. 164,128 filed on even date herewith by the instant applicant the specification of which is herein incorporated by reference. In this speaker system, square planar diaphragms for bass, mid, treble and, if desired, other ranges are coaxially arranged.

SUMMARY OF THE INVENTION

An object of the present invention is to eliminate the above described drawbacks accompanying the conventional loudspeaker systems.

Another object of the invention is to provide a coaxial multi-way planar diaphragm type loudspeaker system which is capable of driving planar diaphragms in a desired uniform reciprocating manner and which provides for the effective escape of heat generated by the voice coils of the speaker system whereby acoustic characteristics are remarkably improved.

The foregoing, as well as other objects of the invention are accomplished by the provision of a driver unit for use in coaxial multi-way planar diaphragm type loudspeaker units which includes a magnetic circuit, a voice coil bobbin having four straight voice coil bobbin units each being provided along a corresponding side of the square planar diaphragm, a voice coil fixedly secured to the voice coil bobbin, a damper having four straight damper units each supporting the corresponding voice coil bobbin and damper supporting stands made of a material having a high heat conductivity for supporting edge portions of the damper. The damper supporting stands are mounted on the outer plates of the magnetic circuit.

DESCRIPTION OF THE PREFERRED EMBODIMENT

Figure 1:
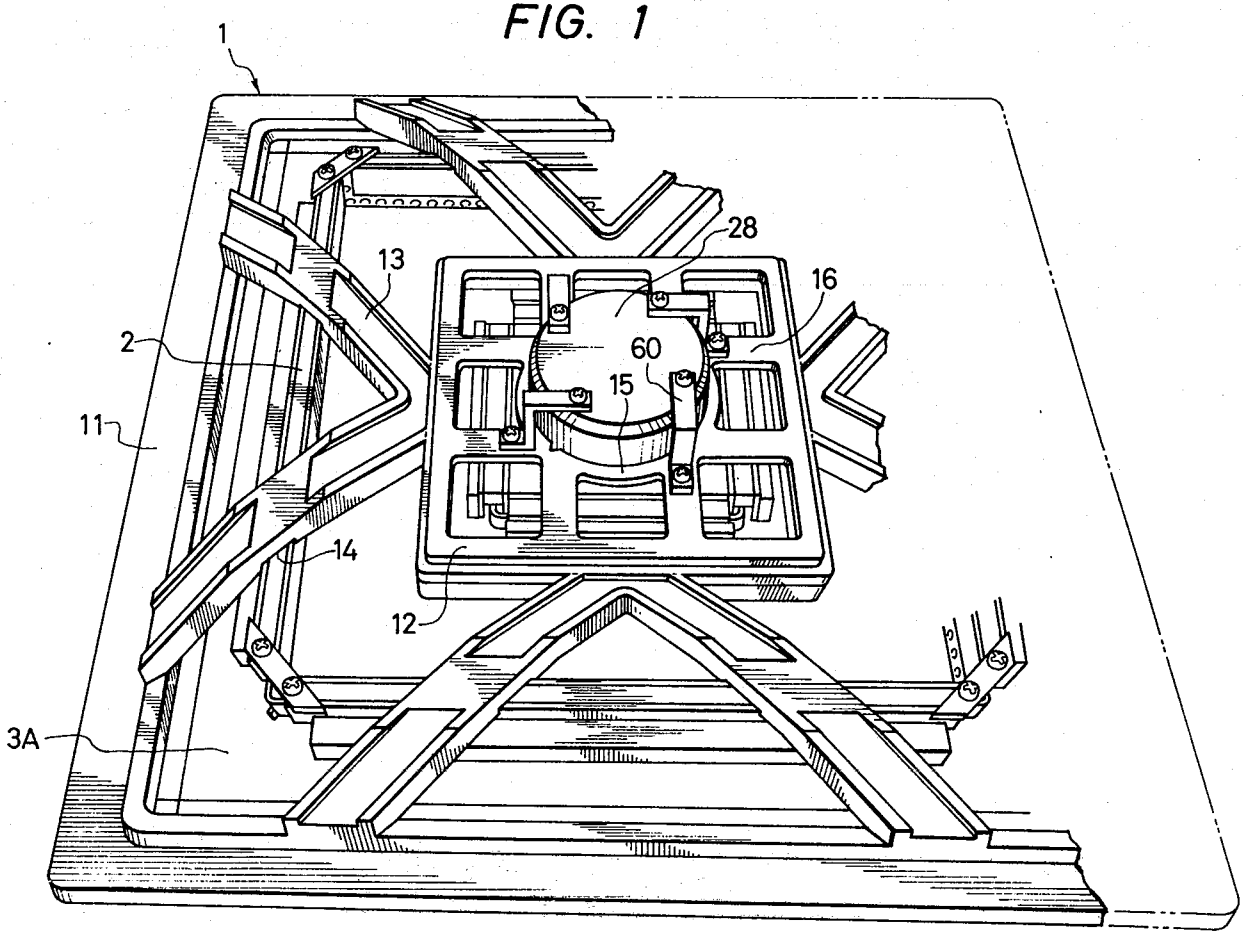
FIG. 1 is a schematic perspective view illustrating the back side of a coaxial multi-way planar diaphragm type loudspeaker system according to the present invention.
Figure 2:
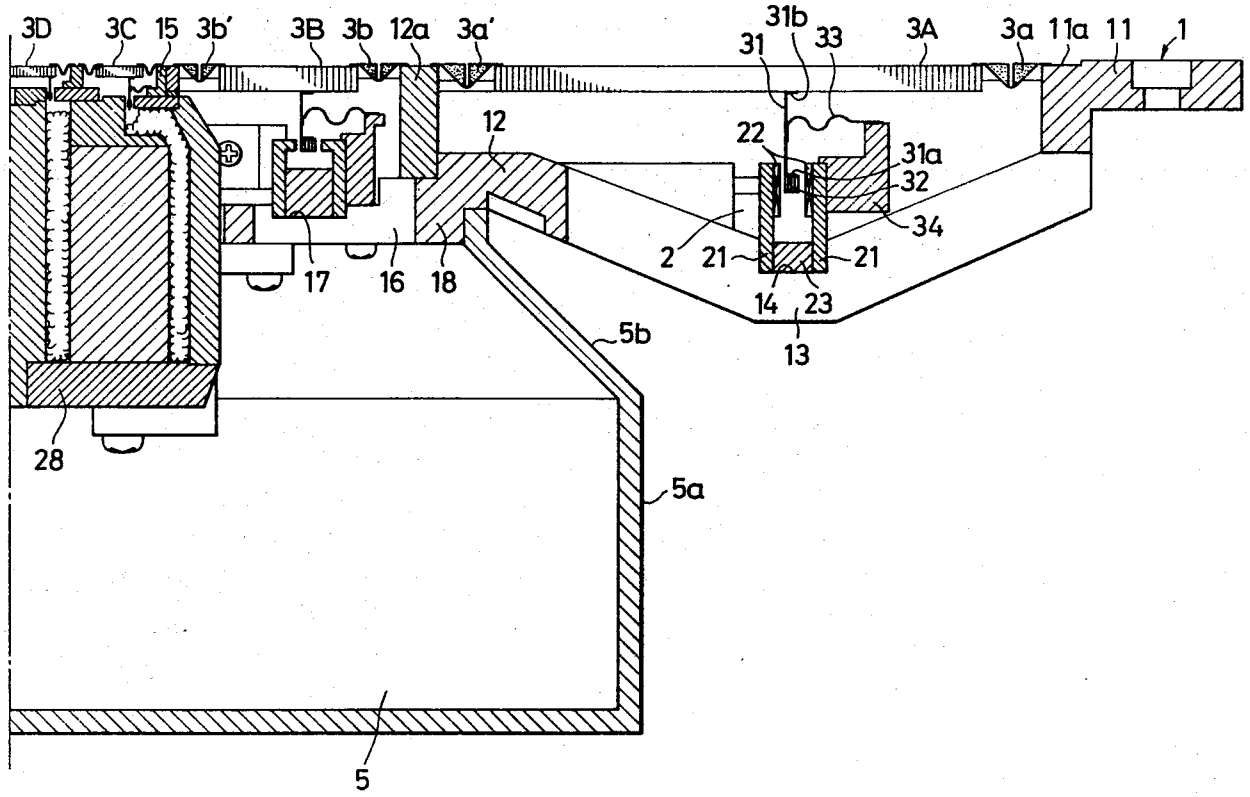
FIG. 2 is a cross-sectional view of the loudspeaker system shown in FIG. 1.

In FIGS. 1 and 2, which are backside and cross-sectional views of a coaxial multi-way planar diaphragm type loudspeaker system according to the present invention reference numeral comprising a set of square planar diaphragms produced by attaching a skin material to a honeycomb core with a bass-range square planar diaphragm 3A, a mid-range square planar diaphragm 3B, a treble-range square planar diaphragm 3C and a super-treble-range square planar diaphragm 3D coaxially arranged in the stated order from the outermost periphery of a frame assembly 1.

Each of the square planar diaphragms is supported by a corresponding portion of the frame assembly 1. For example, the bass-range square planar diaphragm 3A is supported by the frame assembly 1 by an outer peripheral edge portion of the diaphragm 3A which is supported by a shoulder portion 11*a* of an outer frame 11 whereas the inner peripheral edge portion of the bass-range diaphragm 3A is supported by an edge support member 12*a* of an inner circumferential frame 12. The diaphragm 3A is provided with four straight voice coil bobbins 31 having flanges 31*a* and 31*b* at opposite ends thereof. Each voice coil bobbin 31 is arranged along one of the sides of the square planar diaphragm 3A. The voice coil bobbin 31 is provided with a voice coil 32 attached to the lower side of the flange 31*a*. A magnetic circuit unit 2 is constituted by a pair of plates 21 facing each other, a yoke 23 bridging the lower ends of the plates 21 and defining an air gap and magnets 22 provided at the upper ends of the plates 21 facing each other. The magnetic circuit unit 2 is mounted on a V-shaped connection bridge 13 at a position such that the voice coil 32 attached to the voice coil bobbin 31 is positioned in the air gap. Further, a damper supporting stand 34 is provided along each of the outer plates 21. The damper supporting stand 34 is made of a material having high heat conductivity such as an aluminum or copper. The voice coil bobbin 31 is suspended by a damper 33 the outer edge portion of which is supported by the damper supporting stand 34.

Figure 3:
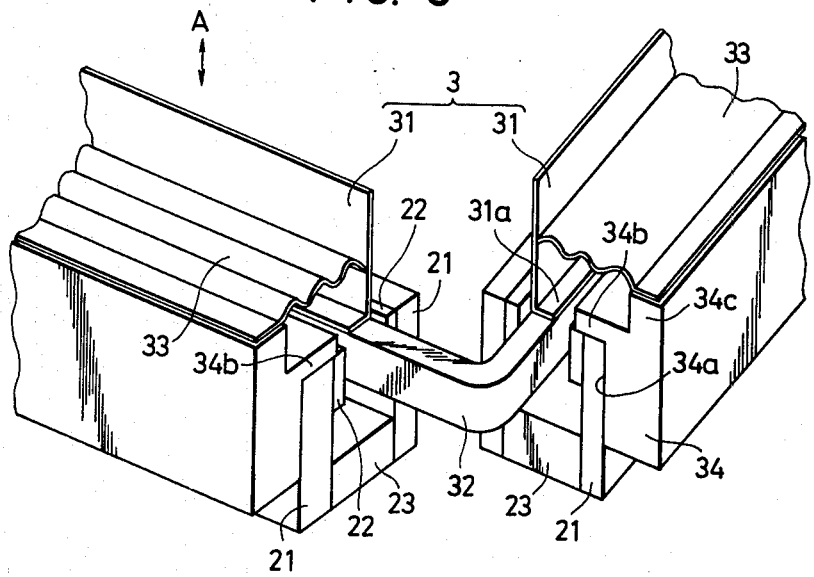
FIG. 3 is a schematic perspective view illustrating a driver unit of the loudspeaker system shown in FIGS. 1 and 2.

As shown in FIG. 3, which is a schematic perspective view illustrating a driver unit of the loudspeaker system of FIGS. 1 and 2, the damper supporting stand 34 has a length equal to that of the plate 21 in the longitudinal direction thereof. The damper supporting stand 34 is provided with a portion 34*a* disposed adjacent the outer periphery of the plate 21, a flange 34*b* being carried by the upper end of the plate 21 and a damper supporting portion 34c having an upper surface at the same level as the voice coil bobbin 31 to which the other end of the damper 33 is attached.

Figure 4:
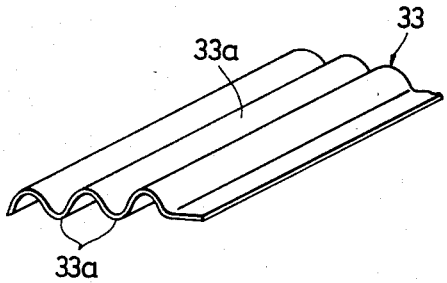
FIG. 4 is a schematic perspective view illustrating a damper used in the loudspeaker system of the present invention.

This damper 33 may be a conventional corrugated damper which is produced by subjecting a warp and woof woven cloth to a suitable treatment. As shown in FIG. 4 the damper 33 has a plurality of corrugated portions 33a in the widthwise direction thereof, it lacks elasticity in the longitudinal direction but has elasticity in the widthwise direction corresponding to the deformation of the corrugated portions 33a.

With the described construction, the voice coil bobbin 31 is driven in the directions indicated by an arrow A in FIG. 3. If the damper 33 had elasticity and could move in various directions, each of the voice coil bobbin could then move in a different manner. As a result, uniform reciprocating movement over the planar diaphragm could not be obtained. However, according to the invention, since the deformation of the damper 33 in its longitudinal direction is prevented but the damper 33 is free to move in a widthwise direction due to corrugated portion 33a, driving power applied vertically with respect to the square planar diaphragm 3A is transmitted through the voice coil bobbin 31 only to the square planar diaphragm 3A. The above described diaphragm, suspension mechanism and magnetic circuit are attached to the frame assembly 1 which may, for example, be made of aluminum.

In the above described square planar diaphragm type loudspeaker system, because heat generated by the voice coil 32 is easily conducted to the damper supporting stand 34 provided on the outer plate 21 of the magnetic circuit unit 2, then the heat can readily escape. It should be noted that the distance between the voice coil bobbin 31 and the damper supporting portion 34c is determined and the size of the damper 33 chosen such that the damper can follow up the reciprocating movement of the square planar diaphragm 3A.

As is apparent from the above description, in a coaxial multi-way square planar type diaphragm loudspeaker system constructed in accordance with the invention, a driver unit constituted by a square-shaped voice coil bobbin suitably performs a driving operation on a square planar diaphragm, a corrugated damper aving a length corresponding to that of the voice coil bobbin and which has elasticity only in its widthwise direction suspends the voice coil bobbin along one edge thereof, and a damper supporting stand made of a material having a high thermal conductivity is provided along the outer plate of a magnetic circuit to support the other edge of the damper. Therefore, the driving power generated by the voice coil is transmitted directly to the square planar diaphragm to allow the diaphragm to be driven only in the vertical direction whereby uniform reciprocating movement over the diaphragm is produced. Furthermore, the suspension mechanism utilized is simple in structure and is capable of readily removing the heat generated by the voice coil from the damper supporting stand.

What is claimed is:

1. A driver unit for a square planar diaphragm type loudspeaker system comprising:

square magnetic circuit means comprising a plurality of straight magnetic circuit sections positioned along corresponding sides of side square planar diaphragm, each of said straight magnetic circuit sections including a pair of parallel plate members, at least one magnet disposed on one end of an inner wall of each said plate member, said magnets facing one another to form an air gap, and a yoke member joining the other ends of said plate members;

a voice coil bobbin attached along one edge thereof to said square planar diaphragm;

a voice coil attached to the other edge of said voice coil bobbin and disposed in said air gap;

damper supporting means mounted on outer plate members of said straight magnetic circuit sections, said damper supporting means being made of a material having high heat-conductivity to transmit heat generated by said voice coil; and damper means having one edge coupled to said voice coil bobbin for suspending said voice coil bobbin and the other edge thereof supported by said damper supporting means.

2. The driver unit of claim 1 wherein said damper means comprise corrugated dampers having elasticity in a direction perpendicular to the plane of said square planar diaphragm.

3. The driver unit of claim 1 wherein said damper supporting means comprises a metal member having a main body portion with one side thereof in thermal contact with an outer wall of one of said plate members, a side flange portion extending over the upper edge of said outer wall and an upper flange portion, said other edge of said damper means being attached to the upper surface of said upper flange portion.

4. The driver unit of claim 2 wherein said damper means comprises a cloth treated to be stiff in the longitudinal direction thereof and corrugated to provide elasticity in said direction perpendicular to said plane of said square planar diaphragm.

* * * * *